US009517881B2

(12) United States Patent
Scherer

(10) Patent No.: US 9,517,881 B2
(45) Date of Patent: Dec. 13, 2016

(54) COMPARTMENTELIZED TRASH CAN

(71) Applicant: Hubert P. Scherer, Naples, FL (US)

(72) Inventor: Hubert P. Scherer, Naples, FL (US)

( * ) Notice: Subject to any disclaimer, the term of this patent is extended or adjusted under 35 U.S.C. 154(b) by 135 days.

(21) Appl. No.: 14/326,797

(22) Filed: Jul. 9, 2014

(65) Prior Publication Data

US 2016/0009490 A1 Jan. 14, 2016

(51) Int. Cl.

| | |
|---|---|
| ***B65F 1/02*** | (2006.01) |
| ***B65F 1/14*** | (2006.01) |
| ***B65F 1/16*** | (2006.01) |

(52) U.S. Cl.

CPC . *B65F 1/02* (2013.01); *B65F 1/16* (2013.01); *B65F 1/1646* (2013.01); *B65F 1/1607* (2013.01); *B65F 1/1623* (2013.01); *B65F 2230/00* (2013.09)

(58) Field of Classification Search

CPC ..... B65F 1/062; B65F 1/0046; B65F 1/1426; B65F 2230/134

See application file for complete search history.

(56) References Cited

U.S. PATENT DOCUMENTS

| | | | | |
|---|---|---|---|---|
| 5,129,543 | A * | 7/1992 | White | B65F 1/006 220/503 |
| 8,910,821 | B1 * | 12/2014 | Stravitz | B65F 1/06 220/495.04 |
| 2009/0126320 | A1 * | 5/2009 | Rousso | B29C 66/1122 53/459 |
| 2015/0075393 | A1 * | 3/2015 | Ho | B65F 1/1405 100/245 |

* cited by examiner

*Primary Examiner* — Sarah McPartlin

(57) ABSTRACT

The inventive concept consists of a compartmentalized trash can including a basic trash can of any configuration. The basic trash can has installed therein, at a lower area, a horizontal plate which is being fastened to the inside walls of the basic trash can thus forming a lower compartment. The lower compartment has an opening at one of the walls of the basic trash can. A half oval cover skirt is formed that has a flat cover plate at the top end to cover the top of the basic trash can. The half oval cover skirt has a depending a half oval cover skirt which is depending from the top cover plate and is connected to the top plate and can be moved by way of a hinge at the top cover plate and can be moved to an upper position exposing the top trash compartment and when it is lowered it will cover the opening in one of the walls of the basic trash can. The top cover plate has an arrangement to close or open an access to the interior of the upper compartment to deposit trash.

1 Claim, 2 Drawing Sheets

COMPARTMENTELIZED TRASH CAN

BACKGROUND OF THE INVENTION

There are many trash cans in use that are especially designed for certain and many different purposes. Trash cans are used in bath rooms, laboratories, office settings, work shops etc. In each of these locations other items are required as a backup for the undertaking in progress. For example, an office setting needs a supply of printing paper during the task in progress. A bath room always needs a second roll of bathroom tissues and a workshop always certain needs implements to support the work in progress. These extra items are stored in close-by boxes or simply clutter the working environment.

BRIEF DESCRIPTION OF THE INVENTION

The invention at hand consists of a trash can that has a separate compartment incorporated therein. The idea behind this invention is to eleviate the above noted problems of not having important items necessary for a particular job or for particular circumstances. One example is the bathroom environment where a back-up roll of bathroom tissues is not readily available. It is normally hidden in a closet or placed somewhere near the toilet where is it somewhat confining the immediate area. Another use of a compartment within a trash can is appreciated in an office environment where a printer is operating and replacement paper is not readily available. A replacement packet is placed inside the extra compartment. It also comes in handy when certain toiletries must be placed nearby a make-up mirror. More various uses of the compartmentalized trash can will suggest itself. The structure of the novel trash can consists of the usually sized trash can which normally has upstanding side walls which normally form an oval structure. A horizontal wall is placed inside the trash can at a lower end thereof and is sealed to the inner sidewalls of the can. This, then forms a compartment at the lower end of the trash can. An opening is formed in the outer wall of the can which allows access to this lower compartment. A cover is formed as an oval skirt to cover the access to this lower compartment. The top of the trash can has a forward end and a rear end location. A cover is formed as a skirt to resemble about half of the trash can including a flat cover which is placed on top of the can. The rear end of the cover is hinged at a point at the rear of the top of the can. This enables the cover to be opened to reveal the interior of the trash can and when closed the cover will cover the opening to the lower compartment. The half oval cover skirt will have a snug fit when lying against the trash can when in its closed or down position. The flat cover lying on top of the can has an opening so that access may be had to the interior of the can without having to pivot the oval shaped cover skirt upwardly. The flat cover has a sliding cover plate that will open or close the opening in the flat cover when activated.

DETAILED DESCRIPTION OF THE INVENTION

Figure 1:
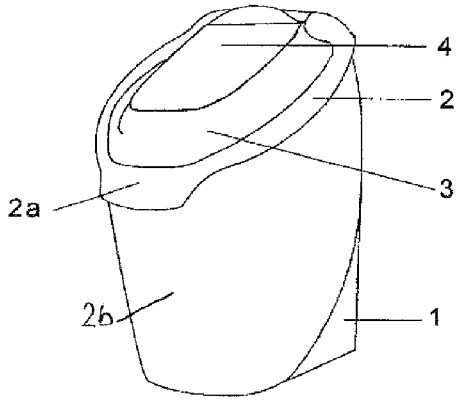
FIG. 1 is a perspective view of the trash can in a closed position.
Figure 2:
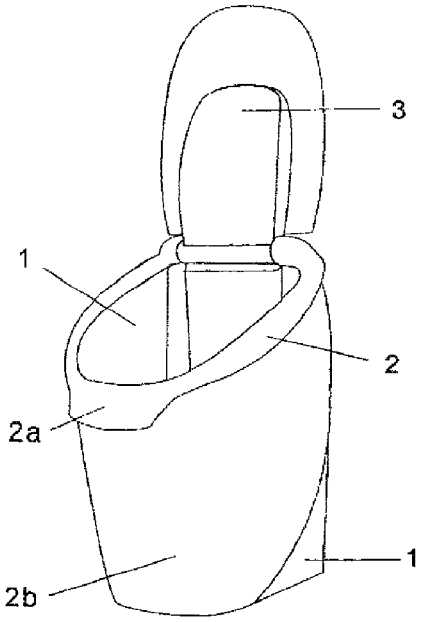
FIG. 2 is a perspective view of the trash can with top flat plate in an open position.

FIG. 1 is a perspective view of the compartmentalized trash can. At 1 is shown the basic trash can which can be of an oval, rectangular or square shape. The oval shape is preferred and is mostly used in the trade. At 2*b* is shown the oval half cover skirt which is in a closed or in a down position and snugly embraces the basic trash can 1. The basic oval cover skirt has attached thereto at its top a flat trash can cover 2 which is operable by way of the handle 2*a*. The handle lifts the whole oval cover skirt 2*b* in and out of its rest position which is shown in a downward mode. The hinged top cover 3 is shown in its closed or downward position. At 3 is shown a slideable closure plate which can be moved outwardly to an open position. This is shown in detail in FIG. 4. Turning now to FIG. 2, there is shown the basic trash can structure with the top cover in an open position. The interior of the trash can 1 is shown. The flat top cover 2 can be operated independently of the basic oval structure 1 or in conjunction therewith. FIG. 2 shows the flat top cover 2 in an open position independent of the basic can 1. In this FIG. The flat top has a hinged plate 3 attached thereto so that the interior of the trash can be addressed.

Figure 3:
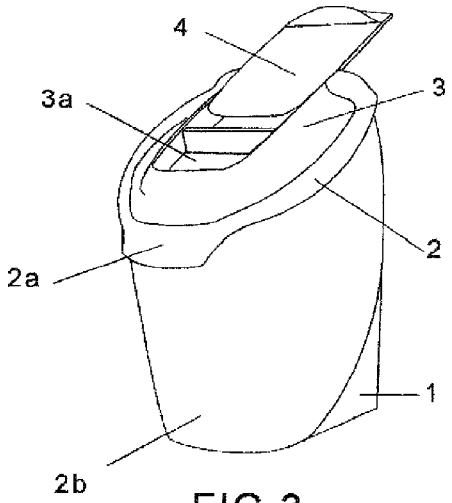
FIG. 3 is a perspective of the trash can showing a slide plate opened to reveal the interior of the can.

FIG. 3 is a perspective of the basic trash can. The top cover 3 is closed but the interior of the can can be addressed by way of a sliding plate 4.

Figure 4:
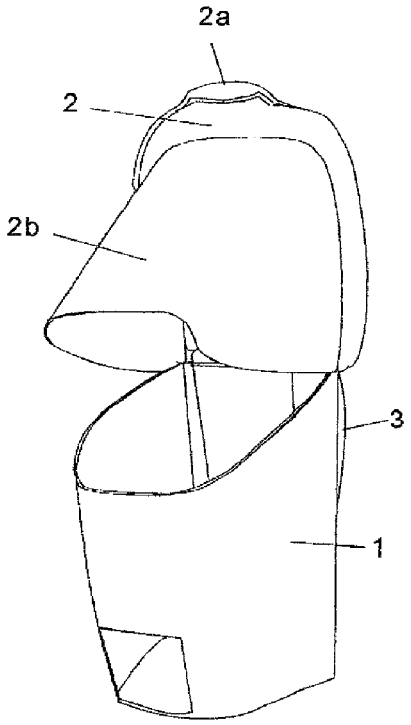
FIG. 4 is a perspective view showing the half oval cover skirt in a raised position to gain access to the lower compartment.

FIG. 4 shows the basic compartmentalized trash can wherein the basic oval cover skirt 2*b* after has been opened over the main trash can 1. The oval cover skirt has been opened by operating the handle 2*a*. The bottom of the main trash can shows the compartment 8 which will be explained by reference to FIG. 5.

Figure 5:
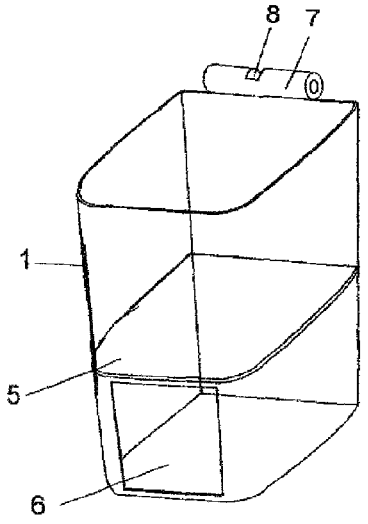
FIG. 5 shows a schematic interior of the trash can.

FIG. 5 illustrates the basic trash can 1 in open schematic. At 5 is shown a horizontal plate which is fastened to the interior walls of the can 1 and thus forms the lower compartment 6 which is not in communication with the upper trash receiving compartment 1*a*. On top and at the rear end of the basic trash can is located a part of the hinge system shown as an elongated cylinder 7. The middle of the cylinder 7 has a groove 8 therein wherein a retainer rib 12 (FIG. 7) of the sliding cover 4 may be guided during its movement.

Figure 6:
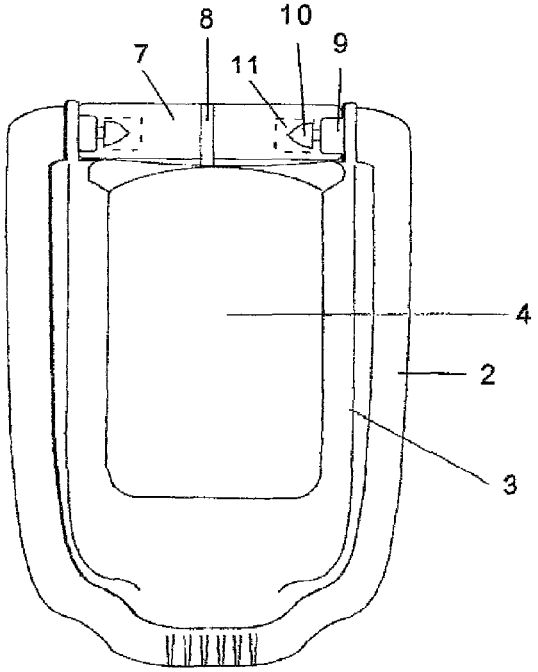
FIG. 6 is a top view of flat top cover plate including a hinge arrangement for this cover.

FIG. 6 Shows the top of the hinged top cover 3 including the slidable closure 4. At the rear end of the top cover there is located the cylinder 7 of the hinge system to aid in the overall movement of the half oval cover skirt 2*b*. Also shown is the guide groove 8 which assists the slide plate 4 in its movement by way of the retaining rib 12 located under the cover 4. The hinge system consists, again, of the cylinder 7 which is located on top of the basis trash can 1 at its rear location. The main cover 3 has a hinge cylinder 9 on both sides of its opening and they direct each end of the hinge cylinder 7. At the inner ends of the two hinge cylinders 7 there are each located pointed hinge pegs which when the assembly takes place are pressed in each end of the hinge cylinder 7 for a good fit and proper guidance when the main oval half of the cover skirt 2*b* is operated.

Figure 7:
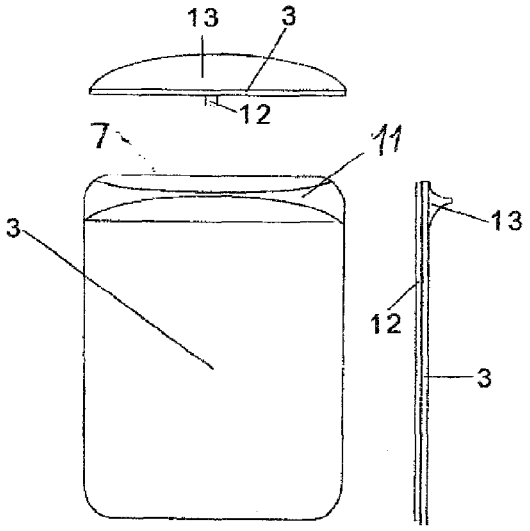
FIG. 7 is an exploded view of the elements of the top cover plate.

FIG. 7 is a somewhat exploded view of the various elements of the compartmentalized trash can. At 11 is shown is shown two opposed receiving openings in the hinge cylinder 7 which eases the introduction of the hinge pegs 10 into the hinge cylinder 7. At 3 is shown the hinged top cover having handle knob 13 and also is shown the retainer rib 12 located under the cover 3 as was explained above. As a side view, the top cover 3 is shown in a vertical position.

The slide rib is shown at 12 and the handle knob is shown at 13.

OPERATION

When in a rest or a normal use position, the trash container is shown in FIG. 1. Entry into the top trash compartment can be had by opening the slide cover 4 or the hinged cover 3 for the purpose of depositing trash. When the circumstances demand that something else is needed, such as a roll of toilet paper, the main half oval cover skirt is lifted to expose the bottom compartment 6 to be able to access the interior to obtain the necessary item.

What I claim is:

1. A compartmentalized trash can consisting of:

a trash can body having a surrounding side wall and a bottom wall;

a horizontal plate fastened to an inside of the surrounding side wall dividing the trash can body into an upper compartment for the reception of trash and a lower compartment accessible through an access hole in said surrounding side wall;

a half oval cover skirt attached to a top end of said trash can body by a top cover plate hingedly attached to a hinge positioned at said top end of said trash can body, wherein when said half over cover skirt is in a closed position, said half oval cover skirt extends downwardly from said cover plate and around an outer surface of said trash can body surrounding side wall covering said access hole.

* * * * *